US012084929B1

(12) United States Patent
Parker et al.

(10) Patent No.: US 12,084,929 B1
(45) Date of Patent: Sep. 10, 2024

(54) RESETTABLE PRESSURE RELIEF VALVE SYSTEM AND METHOD FOR USE WHEN DRILLING WITH A ROTATING CONTROL DEVICE

(71) Applicant: PRUITT TOOL & SUPPLY CO., Fort Smith, AR (US)

(72) Inventors: Martyn Parker, Fort Smith, AR (US); Benjamin Micah Spahn, Alma, AR (US); Jason Finley, Greenwood, AR (US)

(73) Assignee: PRUITT TOOL & SUPPLY CO., Fort Smith, AR (US)

( * ) Notice: Subject to any disclaimer, the term of this patent is extended or adjusted under 35 U.S.C. 154(b) by 0 days.

(21) Appl. No.: 18/190,860

(22) Filed: Mar. 27, 2023

Related U.S. Application Data

(63) Continuation of application No. 17/085,488, filed on Oct. 30, 2020, now Pat. No. 11,613,946.

(60) Provisional application No. 62/928,639, filed on Oct. 31, 2019.

(51) Int. Cl.
*E21B 21/10* (2006.01)
*E21B 21/08* (2006.01)

(52) U.S. Cl.
CPC ..... *E21B 21/106* (2013.01); *E21B 21/08* (2013.01)

(58) Field of Classification Search
CPC ..... E21B 21/106; E21B 21/08
See application file for complete search history.

(56) References Cited

U.S. PATENT DOCUMENTS

2013/0299240 A1* 11/2013 Leuchtenberg ..... E21B 21/08 175/48

* cited by examiner

*Primary Examiner* — Dany E Akakpo
(74) *Attorney, Agent, or Firm* — Schrantz Law Firm, PLLC; Stephen D. Schrantz

(57) ABSTRACT

A pressure relieve valve (PRV) secures to the rotating control device (RCD) in a drilling operation. The PRV located at rig flowline secures to a PRV line, such as PRV piping that bypasses the MPD choke, MPD system, UBD systems, and other flow control device(s). The outlet of the RCD is routed via the pressure relief valve to discharge to a safe contained area. Such discharge relieves overpressure of the wellbore to a contained environment via the rig flowline.

20 Claims, 4 Drawing Sheets

RESETTABLE PRESSURE RELIEF VALVE SYSTEM AND METHOD FOR USE WHEN DRILLING WITH A ROTATING CONTROL DEVICE

CROSS-REFERENCE TO RELATED APPLICATIONS

This application is a continuation of U.S. patent application Ser. No. 17/085,488 filed on Oct. 30, 2020 entitled RESETTABLE PRESSURE RELIEF VALVE SYSTEM AND METHOD FOR USE WHEN DRILLING WITH A ROTATING CONTROL DEVICE continuation in part of U.S. Patent Application No. 62/928,639 filed on Oct. 31, 2019 entitled RESETTABLE PRESSURE RELIEF VALVE INSTALLED DIRECTLY ON THE RCD BOWL/BODY AND RELIEF LINE ROUTING FOR USE WHEN DRILLING WITH A ROTATING CONTROL DEVICE.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention is related to any drilling operation using a Rotating Control Device (RCD). The present invention may be implemented in a conventional overbalanced drilling, a pressurized Managed Pressure Drilling (MPD), or an Underbalanced Drilling Operation (UBD). In any application where an RCD is used, the potential risk of unintentional overpressure to the wellbore exists. Such overpressure potentially leads to the RCD sealing element failing or bursting. When an RCD element fails, the pressurized well bore fluid is released via the failed element. The force caused by the fluid released via the failed element is directed upwards towards the rig floor directly below the rotary bushings. Element failures have in the past had sufficient force to lift rig floor decking. The failure potentially leads to personnel injury to workers on the rig floor. The present invention places a resettable Pressure Relief Valve ("PRV") directly onto the RCD bowl for discharge to a safe contained area. More specifically, the PRV is routed directly to the downstream side of the isolation valve that isolates return drilling mud flow back to the rig's drilling mud return system, a contained and atmospheric system.

SUMMARY OF THE INVENTION

The present invention incorporates a pressure relieve valve (PRV) secured to the rotating control device (RCD).

The PRV located at rig flowline enables the system to bypass the MPD choke, MPD system, UBD systems, and other flow control device(s). An outlet of the RCD is routed via the pressure relief valve to discharge to a safe contained area. Such discharge enables the present invention to relieve overpressure of the wellbore to a contained environment to reduce the likelihood of harm to drilling personnel and to reduce damage to the equipment. In one embodiment, the relief valve directs the discharge to the downstream side of the isolation valve to the drilling mud return system.

The pressure relief valve and PRV piping/line relieve pressure to the side of the RCD by discharging the pressure to the side via the PRV and PRV piping. The pressure relief valve and PRV piping discharge the pressure from the wellbore to the side of the RCD. Such discharge may be needed under the situations below involving deadhead of the rig flowline isolation valve, unplanned choke, flow control device plugging, operator error, and equipment failure.

During conventional drilling, the Rig Flowline Isolation Valve should remain open. However, the Rig Flowline Isolation Valve may accidentally close or the incorrect valve line up. The rig flowline isolation valve could become blocked, clogged, or otherwise closed, such as deadhead. Such blockage, clog, other inadvertent closing, or deadhead of the rig flowline isolation valve potentially causes the pressure in the well bore to rise rapidly and could cause RCD seal element failure. The Rig Flowline Isolation Valve may be a flow control device, an MPD system, a UBD system, or other component of a drilling system.

The PRV and PRV piping also discharge pressure from the wellbore during MPD and UBD operations. During MPD or UBD operations, a flow control device, such as a choke, is used downstream of a second RCD outlet, isolation valve. Unplanned choke/flow control device plugging, operator error or equipment failure again could lead to pressure in the well bore increasing rapidly and potentially causing RCD seal element failure.

In the Examples above, the present invention implements a resettable Pressure Relief Valve set to relieve pressure at a relief set point, such as a predetermined set point, below the maximum allowable working pressure (MAWP) of the RCD. The PRV discharge is routed to divert flow to the downstream side of the Rig Flowline Isolation Valve to reduce the likelihood of catastrophic RCD element failures and associated risks. The PRV of one embodiment is resettable as if the PRV failed open during MPD or UBD operations. Such opening of the PRV allows discharge of the overpressured wellbore. The PRV closes again once the pressure is returned to operable conditions in which the pressure has returned to the proper pressure range, including but not limited to the maximum allowable working pressure (MAWP) of the RCD or the lowest pressure rated component in the system. Leaving the PRV open, such as during underbalanced mud weight, could lead to an undesirable well control influx event.

PRVs have been used regularly in MPD and UBD operations, particularly offshore. In a Surface BOP stack configuration, the PRV is typically located downstream of the RCD outlet and the isolation valve and located upstream of the choke/flow control device.

The present invention positions the PRV directly onto the RCD bowl (body). The PRV is piped to direct any pressure release of drilling fluid to the downstream of Rig Flowline Isolation Valve into the rigs atmospheric and contained system. Such piping of the PRV discharge prevents releasing the drilling mud to the environment.

It is an object of the present invention to provide a system for discharging pressure from the wellbore.

It is an object of the present invention to provide a method for discharging pressure from the wellbore It is also an object of the present invention to position a PRV on a surface stack RCD bowl/body.

It is also an object of the present invention to control the direction of the discharge of the pressure of the wellbore.

It is also an object of the present invention to reduce the potential failure of an RCD element and/or seals.

In addition to the features and advantages of the present invention, further advantages thereof will be apparent from the following description in conjunction with the appended drawings.

These and other objects of the invention will become more fully apparent as the description proceeds in the following specification and the attached drawings. These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
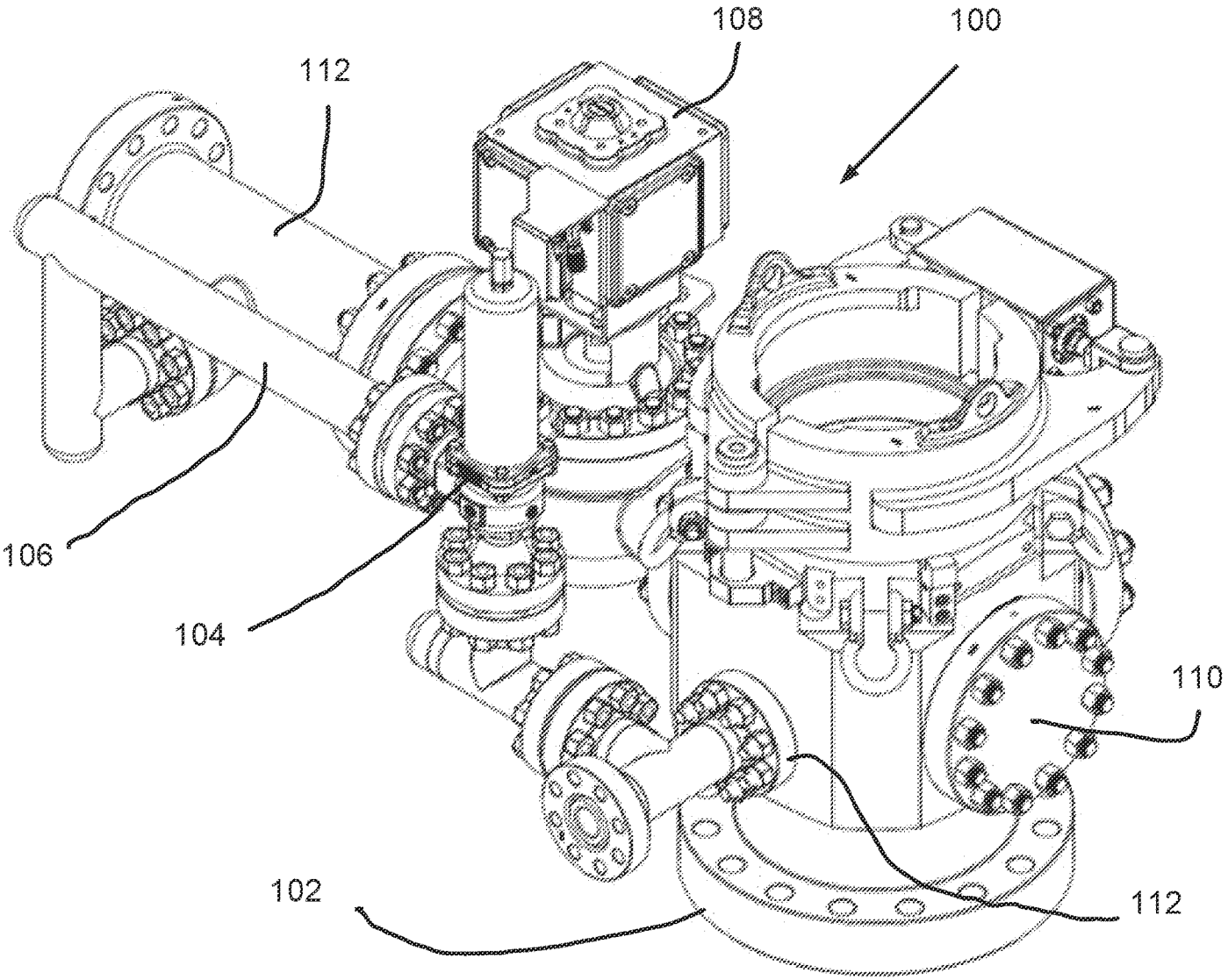
FIG. 1 is an environmental view of one embodiment of the present invention.
Figure 2:
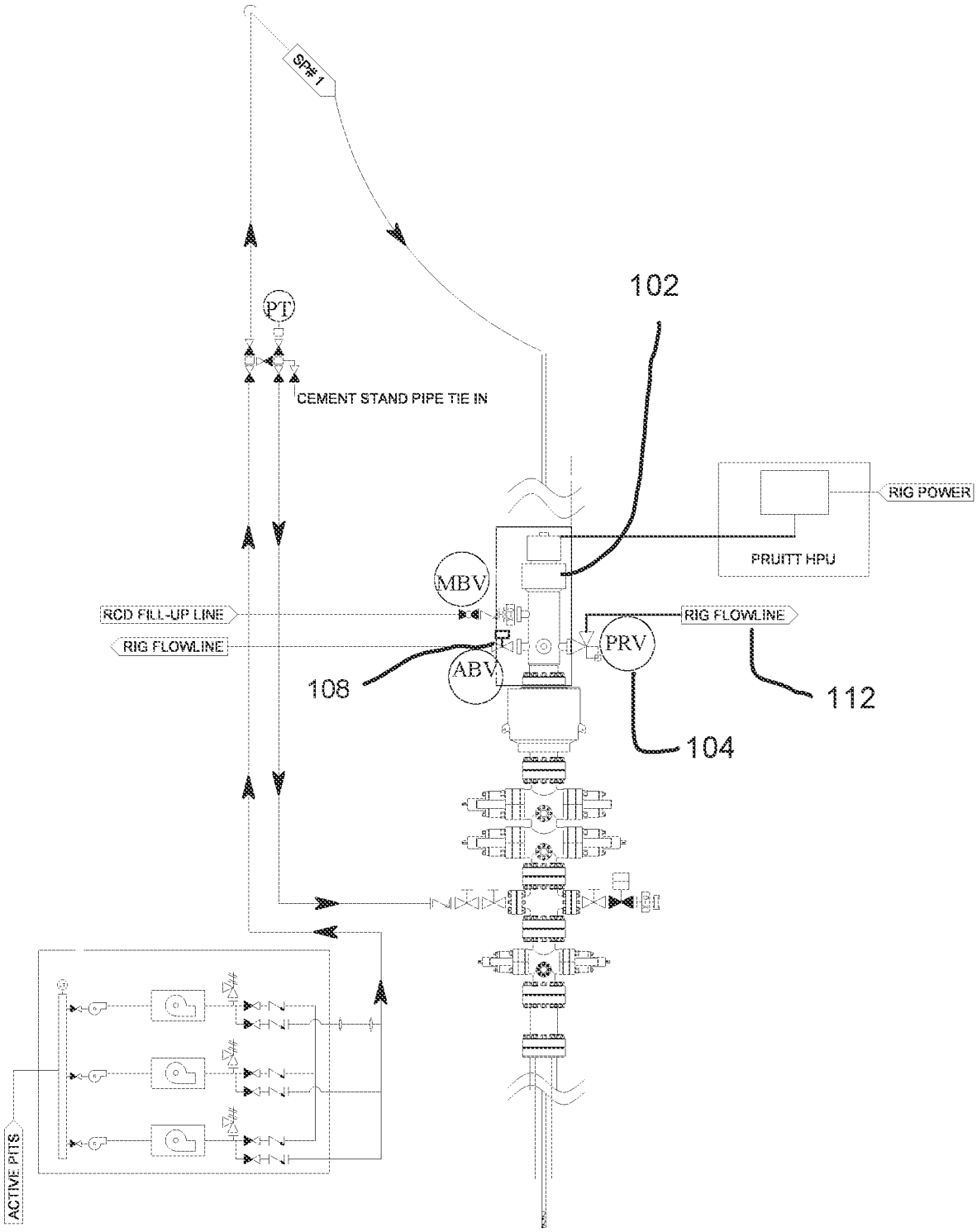
FIG. 2 is a schematic view thereof.

The present invention provides a pressure relief system 100 with a pressure relief valve (PRV 104) secured to the rotating control device (RCD 102) as shown in FIGS. 1 and 2. The PRV 104 is resettable to allow for continued drilling operations.

During any drilling operation that uses an RCD 102, a potential risk of an overpressure event exists. The overpressure event may be caused by human error, equipment failure, or debris return in the flow from the wellbore being drilled. Such debris potentially blocks a valve or choke/flow control device in the line. In MPD/UBD systems, the blockage could occur when debris potentially blocks the MPD/UBD system or when a smaller ID high pressure flowline is routed to an MPD/UBD system.

Any such overpressure event can cause a failure of the RCD element. Failure of the RCD element potentially leads to pressurized drilling fluid being released below the rig floor in the area of the rotary table.

Such events could result in rig floor deck plates and even the rotary bushings being lifted out of place. These events potentially injure personnel on the rig floor and could have fatal consequences if the person/personnel was in the wrong place at the time of failure.

Figure 3:
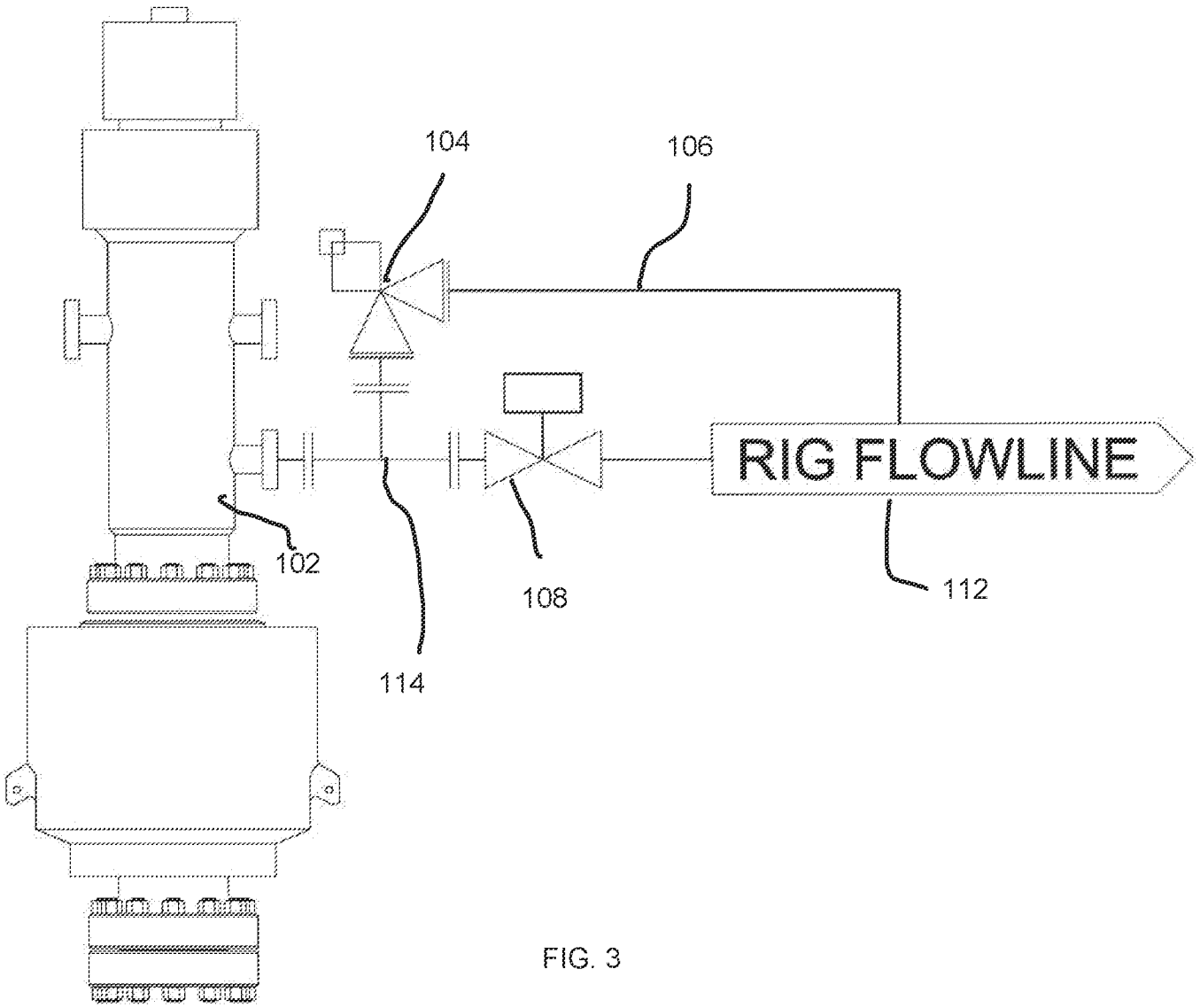
FIG. 3 is a schematic view of one embodiment of the present invention.

FIG. 2 shows one embodiment in which the RCD 102 has two outlets. The PRV 104 connects to one outlet of the RCD 102. The Rig Flowline Isolation Valve 108 connects to another outlet of the RCD 102. As shown in FIG. 3, the PRV 104 and Rig Flowline Isolation Valve 108 may be connected to the same outlet of the RCD 102. The resettable PRV 104 is physically located on the RCD bowl 102 (body). Such positioning of the PRV 104 on the RCD 102 protects the RCD elements from any downstream blockage event, including accidental closure of valve 108. The PRV 104 must have a set point that is designed to protect the maximum allowable working pressure (MAWP) of the RCD or the lowest pressure rated component in the system 100.

The PRV 104 secures to the rotating control device (RCD). The PRV 104 located at rig flowline enables the system to bypass any MPD choke and UBD system that attaches at flange 110. The outlet of the RCD 102 is routed via the pressure relief valve 104 to discharge to a safe contained area through the rig flowline 112. Such discharge enables the PRV system 100 to relieve overpressure of the wellbore to a contained environment to reduce the likelihood of harm to drilling personnel and to reduce damage to the equipment. In one embodiment, the relief valve 104 directs the discharge to the downstream side of the isolation valve 108 to the drilling mud return system at the rig flowline 112.

The pressure relief valve 104 and PRV line 106 relieve pressure to the side of the RCD 102. The pressure relief valve 104 and PRV line 106 discharge the pressure from the wellbore to the side of the RCD 102. Such discharge may be needed under the situations involving deadhead of the rig flowline isolation valve, unplanned choke, flow control device plugging, operator error, and equipment failure.

During conventional drilling the Rig Flowline Isolation Valve 108 should remain open. However, the Rig Flowline Isolation Valve 108 may accidentally close or the incorrect valve line up. The rig flowline isolation valve 108 could become blocked, clogged, or otherwise closed, such as deadhead. Such blockage, clog, other inadvertent closing, or deadhead of the rig flowline isolation valve 108 potentially causes the pressure in the well bore to rise rapidly and could cause RCD seal element failure.

The PRV 104 and PRV line 106 also discharge pressure from the wellbore during MPD and UBD operations. During MPD or UBD operations, a flow control device, such as a choke, is used downstream of a second RCD outlet 110. Unplanned choke/flow control device plugging, operator error or equipment failure again could lead to pressure in the well bore increasing rapidly and potentially causing RCD seal element failure.

In the Examples above, the present invention implements a resettable Pressure Relief Valve 104 set to relieve pressure at a predetermined set point below the MAWP of the RCD 102. The PRV 104 discharge is routed to divert flow to the downstream side of the Rig Flowline Isolation Valve 108 to reduce the likelihood of catastrophic RCD element failures and associated risks. The PRV 104 of one embodiment is resettable as if the PRV 104 failed open during MPD or UBD operations. Such opening of the PRV 104 allows discharge of the overpressured wellbore. The PRV 104 closes again once the pressure is returned to operable conditions in which the pressure has returned to the proper pressure range. Leaving the PRV 104 open, such as during underbalanced mud weight drilling, could lead to an undesirable well control influx event.

PRV 104 secures to a flange of the RCD 102 to provide a bypass of at least one flow control device, including chokes, MPD systems, and UBD systems. The PRV 104 enables drilling fluid to bypass the valve 108 and any MPD/UBD systems secured at flange 110. The PRV 104 directs drilling fluid to the PRV line 106. The PRV line 106 secures to the rig flowline 112 to direct the drilling fluid to the mud system. The PRV line 106 and PRV 104 bypass the valve 108 and any system connected to flange 110. Such PRV line 106 and PRV 104 direct the pressurized drilling fluid to the side to a contained environment through the Rig Flowline 112.

FIG. 3 shows another embodiment of the present invention in which the PRV 104 and the Rig Flowline Isolation Valve 108 are connected to the same outlet of the RCD 102. The flow of the drilling fluid and/or pressure flows from the RCD 102 to a spool 114, or other device that can direct the drilling fluid in two different paths. One path directs the drilling fluid and/or pressure through the Rig Flowline Isolation Valve 108 to the rig flowline 112. The other path directs the drilling fluid and/or pressure through the PRV 104 to the rig flowline 112 without passing through the Rig Flowline Isolation Valve 108.

Figure 4:
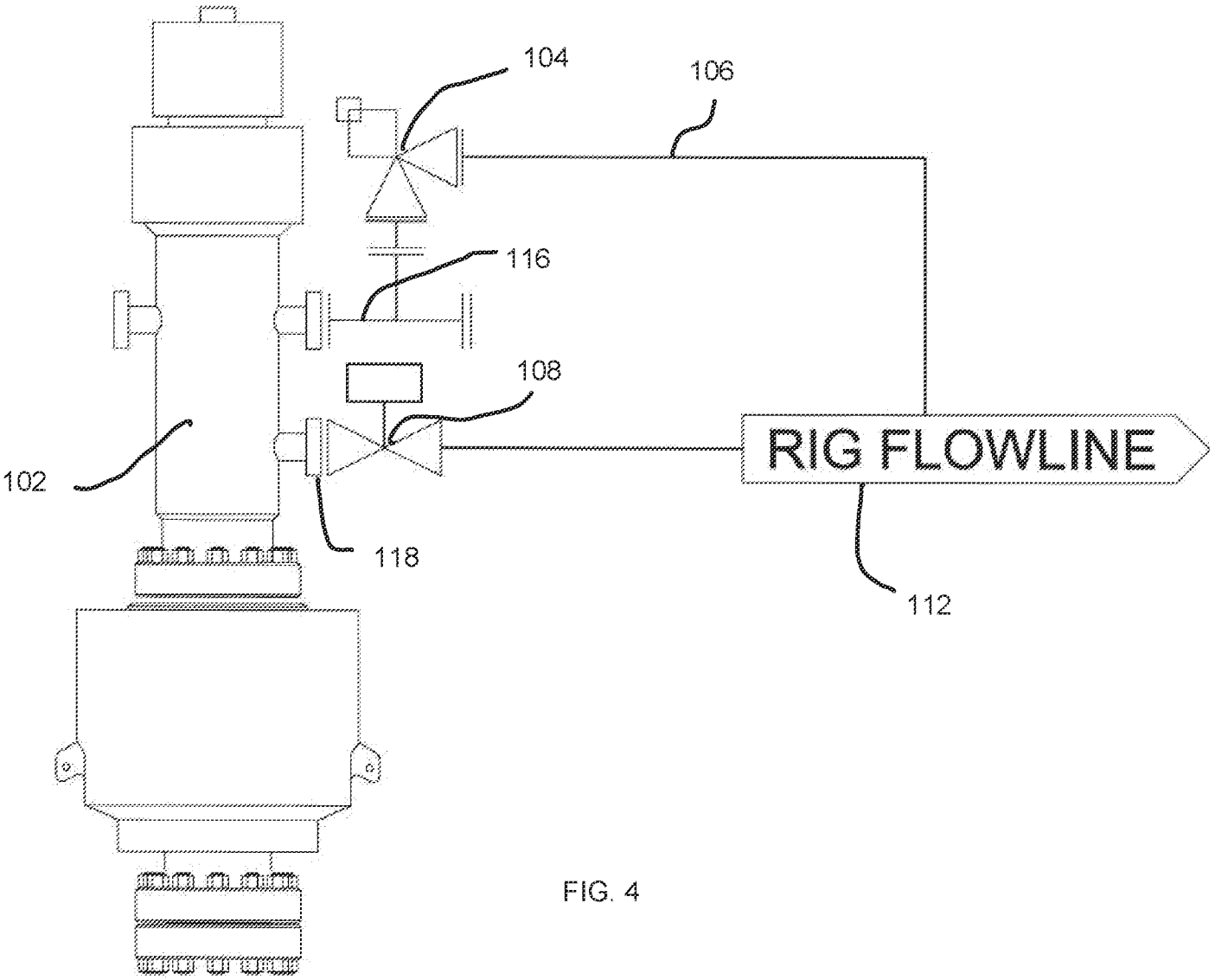
FIG. 4 is a schematic view of one embodiment of the present invention.

FIG. 4 shows the first path 116, such as a relief path, of the drilling fluid and/or pressure that directs the drilling fluid and/or pressure through the PRV 104 and PRV line 106 to the rig flowline 112. The PRV opens upon when the pressure reaches a relief set point. Upon reaching the pressure of the relief set point, the PRV 104 opens to direct the drilling fluid and/or pressure through the PRV line 106 to the Rig Flowline 112 for relieving the pressure. Once the pressure decreases below the relief set point, the PRV 104 closes.

FIG. 4 also shows the second path of the drilling fluid and/or pressure through the second path 118, such as an operation path, that directs the drilling fluid and/or pressure through the Rig Flowline Isolation Valve 108. The drilling fluid travels through second path 118, such as the operation path, during drilling operations. The drilling fluid travels through the Rig Flowline Isolation Valve 108, such as an MPD system, a UBD system, a flow control device, or other component of the drilling system, to the rig flowline 112.

The first path 116, such as the relief path, allows for unclogging of the second path 118. A pump positioned in the second path 118 may clear the second path 118. The pump directs the drilling fluid and/or clog through the rig flowline isolation valve 108 to unclog the second path 118.

As shown in FIG. 4, the first path 116 and the second path 118 flow from the RCD 102. In one embodiment, the PRV 104 and the Rig Flowline Isolation Valve 108 may be connected to different outlets of the RCD 102. The first path 116 may be connected to one outlet of the RCD 102 and the second path 118 may be connected to another outlet of the RCD 102.

In another embodiment, the PRV 104 and the Rig Flowline Isolation Valve 108 may be connected to the same outlet of the RCD 102. A spool or other device that allows the drilling fluid to flow in two different paths is connected upstream of the PRV 104 and the Rig Flowline Isolation Valve 108. The first path 116 may be connected to one outlet of the spool and the second path 118 may be connected to another outlet of the spool.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A pressure relief system for a rotating control device (RCD) of a drilling operation for the flow of drilling fluid, the system comprising:

a pressure relief valve (PRV) through which drilling fluid from the RCD flows;

an isolation valve located downstream of the RCD, wherein closing the PRV directs the drilling fluid to flow from the RCD to the isolation valve; wherein the isolation valve limits adjustment to two positions, wherein the isolation valve adjusts to an open position and a closed position;

a PRV line connected to the PRV for flow of the drilling fluid, wherein the PRV line directs the drilling fluid through the PRV downstream of the isolation valve, wherein the PRV line bypasses the isolation valve when flowing downstream of the isolation valve;

an operation path from the RCD through the isolation valve, wherein the operation path directs the drilling fluid through the isolation valve and at least one drilling component, wherein the at least one drilling component is distinct from the isolation valve, wherein no drilling component of the operation path is located upstream of the isolation valve; and wherein the PRV line and the PRV are located upstream of the isolation valve.

2. The system of claim 1 further comprising:

a drilling mud return system located downstream of the isolation valve, wherein the PRV line bypasses the isolation valve and directs the drilling fluid to a downstream side of the isolation valve, wherein the drilling fluid flows through the PRV line to bypass the isolation valve and flow directly into the drilling mud return system;

wherein the drilling fluid flowing through the PRV line is isolated to the drilling mud return system.

3. The system of claim 2, wherein the PRV relieves pressure at a relief set point below a maximum allowable working pressure of the RCD, wherein the PRV directs the drilling fluid to bypass the isolation valve to flow to the drilling mud return system to relieve pressure;

wherein the PRV closes below the relief set point to direct the drilling fluid to the isolation valve.

4. The system of claim 2, wherein the PRV opens at a relief set point to direct the drilling fluid to bypass the isolation valve to flow directly to the drilling mud return system, wherein the relief set point is below a maximum allowable working pressure of the RCD;

wherein the PRV closes below the relief set point to direct the drilling fluid to the isolation valve.

5. The system of claim 2, wherein the drilling fluid flows in the operation path through the isolation valve to the drilling mud return system;

wherein closing the PRV directs the drilling fluid through the operation path and the isolation valve to the drilling mud return system wherein the PRV opens to relieve pressure at a relief set point, wherein the PRV opens to direct the drilling fluid through the PRV line to bypass the operation path and the isolation valve to flow directly to the drilling mud return system to relieve pressure, wherein the PRV closes to direct the drilling fluid through the operation path and the isolation valve to the drilling mud return system if the pressure is below the relief set point.

6. The system of claim 2, wherein the PRV opens at a relief set point to direct the drilling fluid to bypass the isolation valve to flow directly to the drilling mud return system, wherein the relief set point is below a lowest pressure rated component in the operation path from the isolation valve to the drilling mud return system, wherein the PRV closes below the relief set point to direct the drilling fluid to the isolation valve.

7. The system of claim 1, wherein the PRV line bypasses a managed pressure drilling system.

8. The system of claim 1, wherein the PRV line bypasses an underbalanced drilling system.

9. The system of claim 1, wherein the PRV line bypasses a flow control device.

10. A pressure relief system for a rotating control device (RCD) of a drilling operation for the flow of drilling fluid to a rig flowline, the system comprising:

a pressure relief valve (PRV) connected to the RCD, wherein the PRV is located downstream of the RCD, wherein the drilling fluid flows from the RCD to the PRV without flowing across a sensor when the drilling fluid flows between the RCD and the PRV;

an isolation valve located downstream of the RCD, wherein closing the PRV directs the drilling fluid to flow from the RCD to the isolation valve;

an operation path of the drilling fluid wherein the drilling fluid flows in the operation path through the isolation valve;

a PRV line connected to the PRV for flow of the drilling fluid downstream of the isolation valve, wherein the PRV line bypasses the isolation valve for flow of the drilling fluid downstream of the isolation valve through the PRV line.

11. The system of claim 10, wherein the PRV relieves pressure at a relief set point, wherein the PRV directs the drilling fluid through the PRV line to relieve pressure, wherein the PRV directs the drilling fluid through the operation path if the pressure is below the relief set point.

12. The system of claim 10, wherein the PRV line bypasses a managed pressure drilling system in the operation path, wherein the PRV line directs the drilling fluid through the PRV line without passing through the managed pressure drilling system;

wherein the PRV line directs the drilling fluid to a downstream side of the isolation valve to bypass the isolation valve and the managed pressure drilling system, wherein the drilling fluid flows through the PRV line to bypass the isolation valve and the managed pressure drilling system.

13. The system of claim 10, wherein the PRV line bypasses an underbalanced drilling system in the operation path, wherein the PRV line directs the drilling fluid through the PRV line without passing through the underbalanced drilling system;

wherein the PRV line directs the drilling fluid to a downstream side of the isolation valve to bypass the isolation valve and the underbalanced drilling system, wherein the drilling fluid flows through the PRV line to bypass the isolation valve and the underbalanced drilling system.

14. The system of claim 10, wherein the PRV line bypasses a flow control device in the operation path, wherein the PRV line directs the drilling fluid through the PRV line without passing through the flow control device;

wherein the PRV line directs the drilling fluid to a downstream side of the isolation valve to bypass the isolation valve and the flow control device, wherein the drilling fluid flows through the PRV line to bypass the isolation valve and the flow control device.

15. The system of claim 10, wherein the relief set point is below a maximum allowable working pressure of the RCD;

wherein the PRV closes below the relief set point.

16. The system of claim 10 further comprising:

a drilling mud return system located downstream of the isolation valve, wherein the PRV line directs the drilling fluid to a downstream side of the isolation valve, wherein the drilling fluid flows through the PRV line to the drilling mud return system and the drilling fluid bypasses the isolation valve when flowing through the PRV line to the drilling mud return system.

17. He system of claim 10, wherein the PRV attaches directly to a flange of the RCD.

18. A method of discharging well bore pressure of drilling fluid from a rotating control device (RCD) to a rig flowline, the method comprising:

discharging the pressure through a pressure relief valve (PRV) located downstream of the RCD;

wherein the PRV opens to relieve pressure at a relief set point, wherein the PRV opens to direct the drilling fluid downstream of an isolation valve to the drilling mud return system without flowing through the isolation valve if the pressure is above the relief set point, wherein the PRV closes to direct the drilling fluid through an operation path if the pressure is below the relief set point;

wherein the operation path flows from the RCD through the isolation valve and at least one drilling component, wherein the at least one drilling component is distinct from the isolation valve, wherein no drilling component of the operation path is located upstream of the isolation valve;

wherein the isolation valve is connected downstream of the RCD.

19. The method of claim 18, wherein the drilling fluid flows from the RCD to the PRV without flowing across a sensor when the drilling fluid flows between the RCD and the PRV.

20. The method of claim 18, wherein opening the PRV directs the drilling fluid through a relief path if the pressure is above the relief set point, wherein the relief path directs the drilling fluid directly to the drilling mud return system and bypasses the isolation valve;

wherein the relief path isolates the drilling fluid through the PRV to the drilling mud return system.

* * * * *